US006803350B2

(12) United States Patent
Lantuejoul et al.

(10) Patent No.: US 6,803,350 B2
(45) Date of Patent: Oct. 12, 2004

(54) LUBRICATING COMPOSITIONS FOR FRICTION MATERIAL INTERFACES

(75) Inventors: Karine Lantuejoul, Harfleur (FR); Kenneth L. McLeod, San Antonio, TX (US); Paul F. Vartanian, Oakland, CA (US)

(73) Assignees: Chevron Oronite Company LLC, San Ramon, CA (US); Chevron Oronite S.A., Paris (FR)

( * ) Notice: Subject to any disclaimer, the term of this patent is extended or adjusted under 35 U.S.C. 154(b) by 2 days.

(21) Appl. No.: 10/155,707

(22) Filed: May 22, 2002

(65) Prior Publication Data

US 2003/0220208 A1 Nov. 27, 2003

(51) Int. Cl.[7] ..... C10M 129/74; C10M 133/16; C10M 141/06

(52) U.S. Cl. ..... 508/487; 508/485; 508/551

(58) Field of Search ..... 508/487, 551

(56) References Cited

U.S. PATENT DOCUMENTS

| | | | | | |
|---|---|---|---|---|---|
| 4,312,767 | A | * | 1/1982 | Adams et al. | 508/159 |
| 4,430,234 | A | * | 2/1984 | Hasegawa et al. | 508/249 |
| 5,064,546 | A | | 11/1991 | Dasai | |
| 5,282,990 | A | * | 2/1994 | Yoneto et al. | 508/500 |
| 5,286,394 | A | * | 2/1994 | Moore | 508/399 |
| 5,629,272 | A | | 5/1997 | Nakazato et al. | |
| 5,719,109 | A | | 2/1998 | Tokashiki et al. | |
| 5,851,962 | A | | 12/1998 | Kaga | |
| 5,866,520 | A | * | 2/1999 | Addagarla et al. | 508/286 |
| 5,885,942 | A | * | 3/1999 | Zhang et al. | 508/184 |
| 5,902,777 | A | | 5/1999 | Hashimoto et al. | |
| 6,255,262 | B1 | * | 7/2001 | Keenan et al. | 508/486 |

FOREIGN PATENT DOCUMENTS

| | | |
|---|---|---|
| EP | 0 747 464 | 12/1996 |
| EP | 0 799 883 | 10/1997 |
| WO | WO 92/02602 | 2/1992 |

* cited by examiner

*Primary Examiner*—Ellen M. McAvoy
(74) *Attorney, Agent, or Firm*—Steven G. K. Lee

(57) ABSTRACT

A certain combination of an oil-soluble fatty acid ester of a polyhydric alcohol and an oil-soluble fatty acid amide act as appropriate friction-modifying agents, which when added to a lubricating oil, exhibit good brake anti-chatter characteristics.

12 Claims, 1 Drawing Sheet

LUBRICATING COMPOSITIONS FOR FRICTION MATERIAL INTERFACES

BACKGROUND OF THE INVENTION

1. Field of the Invention

This invention relates to lubricating oil compositions, particularly to lubricating oil compositions useful as functional fluids in systems requiring coupling, hydraulic fluids and/or lubrication of relatively moving parts. It is concerned with functional fluids for use in the lubrication of heavy machinery, particularly high-power-output tractors. More particularly, the present invention is concerned with the reduction of brake and clutch noise.

2. Description of the Related Art

The use of heavy machinery, such as a tractor, has increased the demand for high-performance lubricating compositions. Modern tractors have many power-assisted components, such as power steering and power brakes. Power brakes can either be of the drum-type or disc-type. The disc-type brakes are preferred, since they have greater braking capacity than drum-type brakes. The preferred disc brakes are the wet-type or oil-immersed brakes, which are immersed in a lubricant and are therefore isolated from dirt and grime. The wet-type brakes are in contact with the lubricating oil.

Such brakes suffer from at least one problem, namely, brake chatter or brake squawk. Brake chatter is a phenomenon where the torque variation of the friction material or reaction plate is large, so as to create harmonic vibrations in the equipment. These vibrations convert to objectionable sound. This phenomenon is a very unpleasant noise that occurs upon application of the brake.

Generally, additives formulated for lubricating oil compositions where the fluid will contact brake materials contain friction modifiers to control brake chatter. The use of friction modifiers of the proper kind reduces the amplitude of the torque variation and reduces the sound. In the past, friction-modifying agents, such as dioleylhydrogen phosphite, have been added to the lubricating oil composition to reduce the brake chatter. Controlling the brake chatter may have the negative side effect of lowering the brake capacity, making the equipment harder to bring to stop.

A further complication in eliminating brake chatter is the desire to use the same functional fluid, not only for the brake lubrication, but also for lubrication of other tractor parts, such as the hydraulic and mechanical power take-offs, the tractor transmission, gears and bearings, and the like. Gear wear may be improved by one friction modifier and not another. Lubricating compositions containing dioleylhydrogen phosphite tend to suffer from very high wear rates, particularly at high temperature. The functional fluid must act as a lubricant, a power transfer means, and as a heat transfer medium. Obtaining a compounded fluid to meet all of these needs without brake chatter is difficult.

SUMMARY OF THE INVENTION

It has now been discovered that a certain combination of one or more oil-soluble fatty acid esters of a polyhydric alcohol and one or more oil-soluble fatty acid amides act as appropriate friction-modifying agents, which when added to a lubricating oil, exhibit good anti-chatter characteristics and gear wear.

Accordingly, the present invention provides an additive composition comprising at least one mixture of additive components comprising:

a) from about 0.5 to about 20 wt % of one or more oil-soluble fatty acid esters of a polyhydric alcohol, and b) from about 0.5 to about 20 wt % of an oil soluble fatty acid amide.

Another aspect of the present invention provides a lubricating oil composition comprising:

a) a major amount of at least one base oil of lubricating viscosity, and b) at least one mixture of additive components comprising:

(i) from about 0.05 to about 2.0 wt % of one or more oil-soluble fatty acid esters of a polyhydric alcohol, and (ii) from about 0.05 to about 2.0 wt % of one or more oil-soluble fatty acid amides.

A further aspect of the present invention provides for an additive concentrate containing one or more diluents and one or more of the additive compositions of the present invention.

A further aspect of the present invention provides a method for making an additive composition and a lubricating oil composition of the present invention by blending the components of the present invention. The resulting respective compositions may contain mixtures of components.

A still further aspect of the present invention also provides a method of lubricating friction material interfaces with a lubricating oil composition of the present invention.

Finally, the present invention provides a method of reducing brake chatter by lubricating the contacting surfaces of brakes with a lubricating oil composition of the present invention.

Among other factors, the present invention is based on the surprising discovery that the unique combination of one or more oil-soluble fatty acid esters of a polyhydric alcohol and one or more of the oil-soluble fatty acid amides in at least one base oil of lubricating viscosity, significantly reduces brake chatter in oil-immersed disc brakes of heavy duty machinery, such as tractors and still provides good gear wear protection.

BRIEF DESCRIPTION OF THE DRAWINGS

In order to assist the understanding of the present invention, reference will now be made to the appended drawing. The drawing is exemplary only, and should not be construed as limiting the invention.

Figure 1:
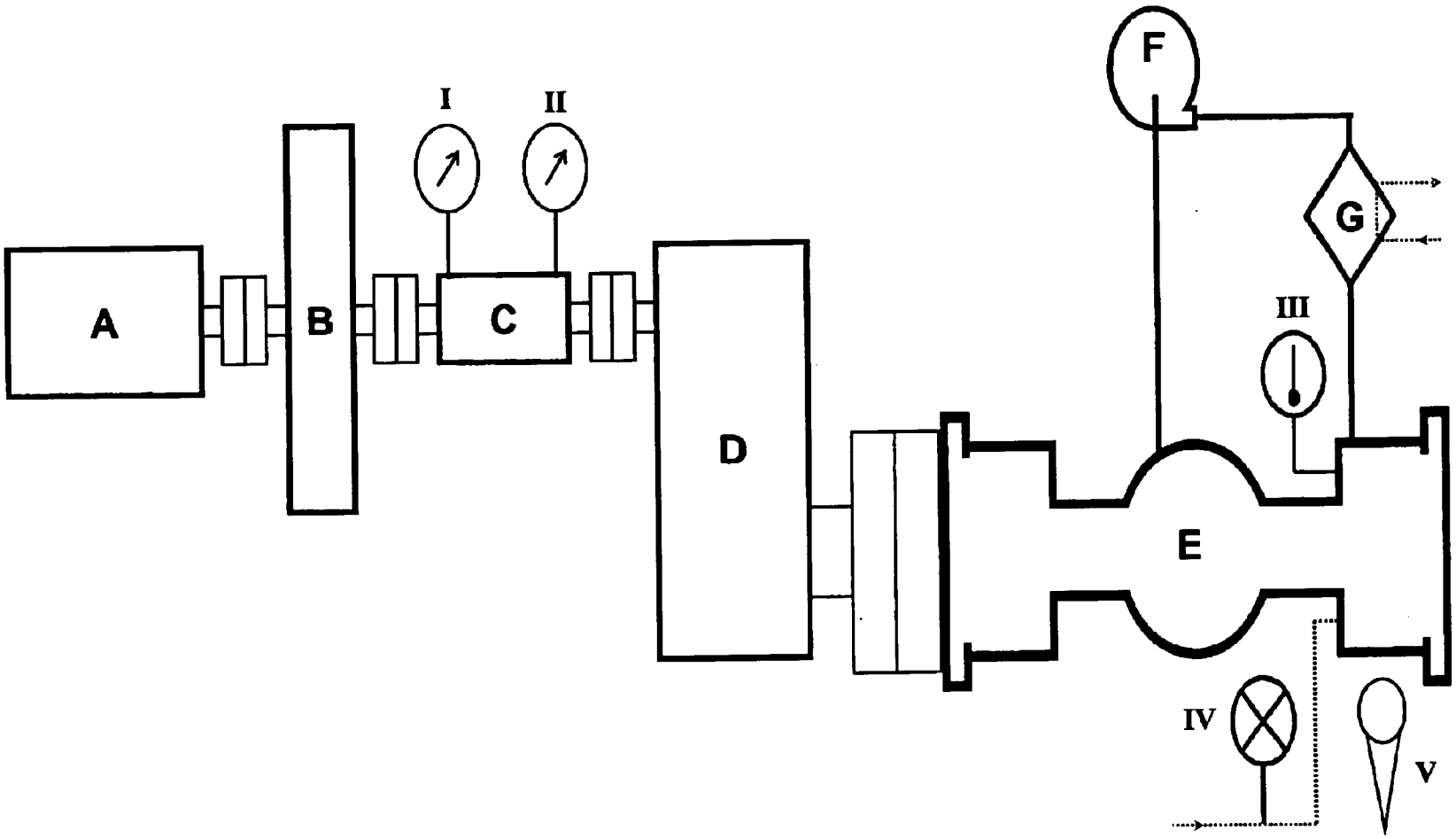
FIG. 1 is a schematic representation of the test machinery used in the present invention. The pertinent elements of the test machinery are designated as follows.

A. Variable Speed Driven 75 HP Electric Motor
B. Flywheel
C. Torque Meter and Speed Sensor
D. 6.68:1 Flender Gearbox
E. Front Axle
F. Pump circulates test fluid
G. Heat Exchanger cools test fluid
I. Speedometer
II. Torque Gauge
III. Temperature Gauge at Brake Pad
IV. Applied Brake Pressure Gauge
V. Noise Meter

DETAILED DESCRIPTION OF THE INVENTION

The present invention relates to a certain combination of one or more oil-soluble fatty acid esters of a polyhydric alcohol and one or more oil-soluble fatty acid amides act as appropriate friction-modifying agents, which when added to a lubricating oil, exhibit good anti-chatter characteristics.

Definitions

Prior to discussing the present invention in detail, the following terms will have the following meanings unless expressly stated to the contrary.

The term "brake chatter" refers to unpleasant noise occurring upon application of the brake.

The term "immersing" refers to dipping, plunging or sinking into a liquid.

The term "splashing" refers to hurling, scattering or tossing a liquid.

The term "spraying" refers to scattering or throwing a liquid in a form of a spray.

Additive Composition

As noted above, the additive composition of the present invention contains at least one mixture of additive components comprising one or more oil-soluble fatty acid esters of a polyhydric alcohol and one or more of an oil-soluble fatty acid. These components will now be described in further detail below.

The Fatty Acid Ester of Polyhydric Alcohol

The fatty acid ester of a polyhydric alcohol employed in the present invention is an ester of a carboxylic acid and a polyhydric alcohol, wherein the carboxylic acid has from about one to about four carboxylic acid groups and from about 8 to about 50 carbon atoms and the polyhydric alcohol has from about 2 to about 50 carbon atoms and from about 2 to about 6 hydroxy groups.

The carboxylic acid employed in the preparation of the ester compound will generally be an aliphatic saturated or unsaturated, straight chain or branched chain, mono- or polycarboxylic acid having from about 1 to about 4 carboxylic acid groups and from about 8 to about 50 carbon atoms.

When the carboxylic acid is a monocarboxylic acid, it will preferably contain about 8 to about 30 carbon atoms, more preferably about 10 to about 28 carbon atoms, and most preferably about 10 to about 22 carbon atoms.

Examples of saturated monocarboxylic acids include those having about 10 to about 22 carbon atoms, such as capric, lauric, myristic, palmitic, stearic and behenic acid. Examples of unsaturated monocarboxylic acids include those having about 10 to about 22 carbon atoms, such as oleic, elaidic, palmitoleic, petroselic, eleostearic, linoleic, linolenic, erucic and hypogaeic acid.

When the carboxylic acid is a polycarboxylic acid, it generally will be an aliphatic saturated or unsaturated polycarboxylic acid having about 2 to about 4, preferably about 2 to about 3, and more preferably about 2 carboxylic acid groups. An example of a suitable dicarboxylic acid is dodecenyl succinic acid.

Preferably, the carboxylic acid is an unsaturated monocarboxylic acid as in oleic acid.

The alcohol used in the preparation of the ester compound is generally an aliphatic, saturated or unsaturated, straight chain or branched chain polyhydric alcohol having from about 2 to about 6 hydroxy groups and from about 2 to about 50 carbon atoms, preferably, from about 2 to about 30 carbon atoms, and more preferably, from about 2 to about 12 carbon atoms.

Suitable polyhydric alcohols include dihydroxy alcohols, such as the alkylene glycols, for example, ethylene glycol and propylene glycol, trihydroxy alcohols, such as glycerol, tetrahydroxy alcohols, such as pentaerythritol, and hexahydroxy alcohols, such as sorbitol.

Preferably, the polyhydric alcohol is a trihydroxy alcohol as in glycerol.

The carboxylic acid and polyhydric alcohol are reacted under typical esterification conditions well known in the art to provide the esters employed in the present invention.

Examples of oil-soluble fatty acid esters of polyhydric alcohols that may be used are those where all of the hydroxy groups are esterified, as well as those where not all of the hydroxy groups are esterified. Fatty acid esters of glycerol are preferred. Specific examples are esters prepared from trihydric alcohols and one or more of the above-mentioned saturated or unsaturated carboxylic acids, such as glycerol monoesters and glycerol diesters, e.g. glycerol monooleate, glycerol dioleate and glycerol monostearate. Such polyhydric esters may be prepared by esterification as described in the art and/or may be commercially available.

The oil-soluble fatty acid ester of a polyhydric alcohol may have one or more free hydroxy groups.

Preferred oil-soluble fatty acid esters of a polyhydric alcohol which are suitable for use in the present invention include glycerol monooleate, pentaerythritol monooleate and sorbitan monooleate, particularly glycerol monooleate and pentaerythritol monooleate. Most preferably, the ester is glycerol monooleate.

On the basis of the finished oil, the additive composition of the present invention may contain from about 0.5 to about 20 wt %, preferably from about 1.0 to about 10 wt %, of one or more oil-soluble fatty acid esters of a polyhydric alcohol.

The Fatty Acid Amide

The oil-soluble fatty acid amide of the present invention may be derived from any natural or synthetic acid or mixture of acids although, a fatty acid is preferred. In general, the fatty acid amide of the present invention will have the following formula: $R—C(O)—NH_2$, wherein R may be a saturated or unsaturated hydrocarbyl group. For adequate oil solubility, the fatty acid should preferably contain at least about 8 carbon atoms per molecule, but amides containing more than about 20 carbon atoms per molecule are relatively inaccessible and therefore less preferred. Amides based on linear saturated or mono-saturated fatty acids containing an even number of carbon atoms are easily available and their use is preferred. Specific examples are stearamide, oleylamide, palmitamide, particularly oleylamide. Oleylamide is the preferred oil-soluble fatty acid amide of the present invention.

On the basis of the finished oil, the additive composition of the present invention may contain from about 0.5 to about 20 wt %, preferably from about 1.0 to about 10 wt %, of one or more oil-soluble fatty acid amides.

Generally, the relative ratio of one or more oil-soluble fatty acid esters of a polyhydric alcohol to one or more oil-soluble fatty acid amides will be from about 4:1 to about 1:4, preferably from about 1:2 to about 2:1.

The combination of friction-modifying additives in accordance with the present invention may be incorporated directly in a finished lubricant or, more usually, in an additive package including other additive components designed to improve the performance of the lubricant for distribution to manufacturers of the finished oil. The package usually contains also about 3.0 to about 20 wt %, preferably about 5.0 to about 10 wt % of a diluent oil such as a base oil of lubricating viscosity. The amount of diluent is limited, but is sufficient to dissolve the required amount of the oil-soluble fatty acid ester of a polyhydric alcohol and the oil-soluble fatty acid amide.

Lubricating Oil Composition

Another aspect of the present invention provides one or more lubricating oil compositions comprising:

a) a major amount of at least one base oil of lubricating viscosity, and b) at least one mixture of additive components comprising:

(i) from about 0.05 to about 2.0 wt % of one or more oil-soluble fatty acid esters of a polyhydric alcohol, and (ii) from about 0.05 to about 2.0 wt % of one or more oil-soluble fatty acid amides.

Base Oil of Lubricating Viscosity

The base oil of lubricating viscosity of the present invention may be mineral oils or synthetic oils. A base oil having a viscosity of at least about 2.5 cSt at about 40° C. and a pour point below about 20° C., preferably at or below 0° C. is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

On the basis of the finished oil, the lubricating oil composition of the present invention may contain from about 0.05 to about 2.0 wt %, preferably from about 0.1 to about 1.0 wt %, more preferably from about 0.2 to about 0.5 wt %, of one or more oil-soluble fatty acid esters of a polyhydric alcohol. The optimum amount of oil-soluble fatty acid ester of a polyhydric alcohol within these ranges will vary slightly depending on the base oil and other additives present in the lubricating oil.

On the basis of the finished oil, the lubricating oil composition of the present invention may contain from about 0.05 to about 2.0 wt %, preferably from about 0.1 to about 1.0 wt %, more preferably from about 0.3 to about 0.8, of one or more oil-soluble fatty acid amides. The optimum amount of oil soluble fatty acid amide within these ranges will vary slightly depending on the base oil and other additives present in the lubricating oil.

Generally, whether the lubricating oil composition of the present invention is used in one or more fully formulated materials or in one or more concentrates as will be described below, the relative ratio of one or more oil-soluble fatty acid esters of a polyhydric alcohol to one or more oil-soluble fatty acid amides will be from about 1:2.

The lubricating oil composition of the present invention is useful in a method of lubricating friction material interfaces. In that method, the lubricating oil composition of the present invention is used to lubricate the friction material interfaces. Friction material interfaces include, but are not limited to, brakes and clutches, such as disc brakes and clutches, internal-expanding rim brakes and clutches, external-contacting rim brakes and clutches, band-type brakes and clutches, cone brakes and clutches, and friction contact axial clutches as described, for example, in *"Mechanical Engineering Design"* by J. E. Shigley, Third Edition, McGraw-Hill, New York, 1977, pp. 224–554, which is herein incorporated by reference for all purposes. One or more methods commonly known in the art may be used in lubricating the friction material surfaces. Such methods may include, but are not limited to, immersing, splashing, spraying, or any combination thereof, the friction material surfaces with the lubricating oil composition of the present invention. A particular method contemplated is the use of the lubricating oil composition of the present invention for reducing brake chatter by lubricating the contacting surfaces of brakes, preferably oil-immersed disc brakes.

The lubricating oil composition of the present invention can be prepared by successively or simultaneously blending the components of the lubricating oil composition of the present invention together at a temperature sufficient to result in the combination of components. For example, the lubricating oil composition of the present invention can be prepared by successively or simultaneously adding the additive components to at least one base oil of lubricating viscosity, or by beforehand preparing the additive composition of the present invention, as herein described above, and then mixing with at least one base oil of lubricating viscosity. The lubricating oil produced might be a slightly different composition than the initial mixture because the components may interact.

Additive Concentrate

The additive concentrate of the present invention usually includes the product produced by blending:

a) from about 3.0 to about 20 wt % of an organic liquid diluent, and b) at least one mixture of additive components comprising:

(i) from about 1.0 to about 15 wt % of one or more oil-soluble fatty acid esters of a polyhydric alcohol, and (ii) from about 1.0 to about 20 wt % of one or more oil-soluble fatty acid amides.

The concentrates contain sufficient organic liquid diluent to make them easy to handle during shipping and storage. Typically, the concentrate will contain from about 3.0 to about 20 wt % of the organic liquid diluent, preferably from about 5.0 to about 10 wt %.

Suitable organic diluents which can be used include, for example, solvent refined 100N, i.e., Cit-Con 100N, and hydrotreated 100N, i.e., Chevron 100N, and the like. The organic liquid diluent preferably has a viscosity of from about 1.0 to about 20 cSt at about 100° C.

The component of the additive concentrate can be blended in any order and can be blended as combinations of components. The concentrate produced by blending the above components might be a slightly different composition than the initial mixture because the components may interact.

Other Additive Components

The following additive components are examples of some of the components that can be favorably employed in the present invention. These examples of additives are provided to illustrate the present invention, but they are not intended to limit it:

A. Metal Detergents

Sulfurized or unsulfurized alkyl or alkenyl phenates, alkyl or alkenyl aromatic sulfonates, carboxylates, salicylates, phenalates, sulfurized or unsulfurized metal salts of multihydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multiacid, and chemical and physical mixtures thereof.

B. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Antioxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butylphenol), 4,4'-isopropylidene-bis(2,6-di-tert-bulylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butylphenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal dithiocarbamate (e.g., zinc dithiocarbamate), and methylenebis (dibutyldithiocarbamate). The anti-oxidant is generally incorporated into an engine oil in an amount of about 0 to about 10 wt %, preferably 0.05 to about 3.0 wt %, per total amount of the engine oil.

C. Anti-Wear/Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc dialkyldithiophosphate (primary alkyl, secondary alkyl, and aryl type), sulfurized oils, sulfurized isobutylene, sulfurized polybutene, diphenyl sulfide, methyl trichlorostearate, chlorinated naphthalene, fluoroalkylpolysiloxane, and lead naphthenate.

D. Rust Inhibitors (Anti-Rust Agents)

1) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

E. Demulsifiers

Addition product of alkylphenol and ethylene oxide, polyoxyethylene alkyl ether, and polyoxyethylene sorbitan ester.

F. Friction Modifiers

Fatty alcohol, fatty acid, amine, borated ester, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

H. Viscosity Index Improvers

Polymethacrylate type polymers, ethylene-propylene copolymers, styrene-isoprene copolymers, hydrated styrene-isoprene copolymers, polyisobutylene, and dispersant type viscosity index improvers.

I. Pour Point Depressants

Polymethyl methacrylate.

J. Foam Inhibitors

Alkyl methacrylate polymers and dimethyl silicone polymers.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Example 1

Samples were prepared according to the below description. In every sample, other additives were also used. These other additives are indicated generically as detergents, dispersants, anti-wear agents, rust inhibitors, seal conditioning agents, foam inhibitors, pour point depressants, and viscosity index improvers because no significant difference was found when these components were varied.

TABLE 1

Composition of Samples Tested

| Component | % of Component in Finished Oil | | |
|---|---|---|---|
| | Sample 1 | Sample 2 | Sample 3 |
| Fatty Acid Ester of Polyhydric Alcohol | 1.0 | 0 | 0.25 |
| Fatty Acid Amide | 0 | 0.5 | 0.5 |
| Base Oil of Lubricating Viscosity | 89.3 | 89.8 | 89.55 |
| Other Additives[a] | 9.7 | 9.7 | 9.7 |

[a]Other additive components include: detergents, dispersants, anti-wear agents, seal conditioning agents, rust inhibitors, foam inhibitors, pour point depressants, viscosity index improvers.

Example 2

Brake noise or chatter was measured by VOLVO Test Specification TUD0109JS, dated 2000 Mar. 06, which is herein incorporated by reference. This is a temperature efficiency test designed to determine the tendency of the fluid to promote objectionable brake noise or chatter. FIG. 1 diagrams the test apparatus used for the measurement.

Basically, a variable speed driven electric motor (A) provides the energy which is transferred by way of a flywheel (B). Speed and torque are monitored by a respective speedometer (I) and torque gauge (II) in a sensor (C). Energy is passed through a gearbox (D) to the front axle (E). Test fluid is circulated by way of a pump (F) and a heat exchanger (G) cools the test fluid. A temperature gauge (III) monitors temperature at the brake pad as brake pressure is applied. A gauge measures applied brake pressure (IV) while a noise meter (V) measures brake noise or chatter. Rotational speed, applied brake pressure, and test fluid temperature are regulated to provide data for various simulated stopping conditions.

Gear wear was tested using the JOHN DEERE JDQ-95 SPIRAL BEVEL/FINAL DRIVE GEAR WEAR METHOD commercially available at Southwest Research Institute in San Antonio, Tex. The following abstract outlines the test.

Specifications

This procedure covers John Deere JDM J20 and JDM J27.

Objective

Performance of the test oil was compared to a reference oil with respect to the scoring of the spiral bevel ring/pinion gears. The wear and surface distress of sun pinion gears can also be evaluated.

Test Fixture

The test fixture was a final-drive axle assembly powered by a six-cylinder diesel engine through a power-shift transmission. A special low-speed/high-torque brake dynamometer absorbs the axle output power.

Test Parameters

Output speeds varied from 24 to 14 axle rpm with axle torques of 23,730 Nm (17,400 lb-ft). Oil temperature was 121° C. (250° F.). Test duration was 50 hours.

The results of the Brake Noise or Chatter and Gear Wear test are summarized in

TABLE 2

Brake Noise or Chatter and Gear Wear

| Test Criteria | Sample 1 | Sample 2 | Sample 3 |
|---|---|---|---|
| Average Noise (dB) | 102 | 86 | 91 |
| JDQ 95 Spiral Bevel Gear Wear Merit Rating | 9 | 6 | 9 |

The results of Table 2 indicate that the composition having the fatty acid ester of polyhydric alcohol (Sample1) suffers high brake noise while providing good gear wear. Sample 2 containing the fatty acid amide has improved brake noise but suffers unacceptable gear wear. However, the composition of the present invention containing both the fatty acid ester of polyhydric alcohol and the fatty acid amide (Sample 3) provides good brake noise and good gear wear.

What is claimed is:

1. A lubricating oil composition comprising:

a) a major amount of at least one base oil of lubricating viscosity, and b) at least one mixture of additive components comprising:

(i) from about 0.05 to about 2.0 wt % of one or more oil-soluble fatty acid eaters of a polyhydric alcohol, and (ii) from about 0.05 to about 2.0 wt % of one or more oil-soluble fatty acid amides having the following formula:

$$R—C(O)—NH_2,$$

wherein R may be a saturated or unsaturated hydrocarbyl group containing at least about 8 carbon atoms per molecule and wherein the ratio of the oil-soluble fatty acid ester of a polyhydric alcohol to the oil-soluble fatty acid amide is from about 4:1 to about 1:2.

2. A lubricating oil composition according to claim 1, wherein the ratio of the oil-soluble fatty acid ester of a polyhydric alcohol to the oil-soluble fatty acid amide is from about 1:2 to about 2:1.

3. A lubricating oil composition according to claim 2, wherein the oil-soluble fatty acid ester of a polyhydric alcohol is from about 0.1 to about 1.0 wt % and the oil-soluble fatty acid amide is from about 0.1 to about 1.0 wt %.

4. A lubricating oil composition according to claim 3, wherein the oil-soluble fatty acid ester of a polyhydric alcohol is from about 0.2 to about 0.5 wt % and the oil-soluble fatty acid amide is from about 0.3 to about 0.8 wt %.

5. A lubricating oil composition according to claim 1, wherein the oil-soluble fatty acid ester of a polyhydric alcohol is a fatty acid ester of glycerol.

6. A lubricating oil composition according to claim 5, wherein the oil-soluble fatty acid ester of glycerol is glycerol monooleate.

7. A lubricating oil composition according to claim 2, wherein the oil-soluble fatty acid amide is oleylamide.

8. A method of making a lubricating oil composition comprising blending together a major amount of at least one base oil of lubricating viscosity, and at least one mixture of additive components comprising:

a) from about 0.05 to about 2.0 wt % of one or more oil-soluble fatty acid esters of a polyhydric alcohol, and b) from about 0.05 to about 2.0 wt % of one or more oil-soluble fatty acid amides, having the following formula:

$$R—C(O)—NH_2,$$

wherein R may be a saturated or unsaturated hydrocarbyl group containing at least about 8 carbon atoms per molecule and wherein the ratio of the oil-soluble fatty acid ester of a polyhydric alcohol to the oil-soluble fatty acid amide is from about 4:1 to about 1:2, at a temperature sufficient to result in the combination of the components.

9. A method of reducing brake chatter by lubricating the contacting surfaces of brakes with a lubricating oil composition comprising:

a) a major amount of at least one base oil of lubricating viscosity, and b) at least one mixture of additive components comprising:

(i) from about 0.05 to about 2.0 wt % of one or more oil-soluble fatty acid esters of a polyhydric alcohol, and (ii) from about 0.05 to about 2.0 wt % of one or more oil-soluble fatty acid amides having the following formula:

$$R—C(O)—NH_2,$$

wherein R may be a saturated or unsaturated hydrocarbyl group containing at least about 8 carbon atoms per molecule and wherein the ratio of the oil-soluble fatty acid ester of a polyhydric alcohol to the oil-soluble fatty acid amide is from about 4:1 to about 1:2.

10. A method of reducing brake chatter according to claim 9, wherein the brakes are oil-immersed disc brakes.

11. The method according to claim 8, wherein the ratio of the oil-soluble fatty acid ester of a polyhydric alcohol to the oil-soluble fatty acid amide is from about 1:2 to about 2:1.

12. The method according to claim 9, wherein the ratio of the oil-soluble fatty acid ester of a polyhydric alcohol to the oil-soluble fatty acid amide is from about 1:2 to about 2:1.

* * * * *